US005142333A

United States Patent [19]

Verbeek et al.

[11] Patent Number: 5,142,333

[45] Date of Patent: Aug. 25, 1992

[54] CIRCUITOUS-FLOW ELECTROSTATIC DEVELOPER ASSEMBLY WITH CONCURRENT AXIAL AND CIRCUMFERENTIAL PARTICLE MOVEMENT

[75] Inventors: Marcel F. Verbeek, Hallaar; Robert F. Janssens, Geel; Jan A. Zwijsen, Wilrijk; Luc K. Van Aken, Kuringen; Serge M. Tavernier, Lint, all of Belgium

[73] Assignee: Afga-Gevaert N.V., Mortsel, Belgium

[21] Appl. No.: 640,169

[22] Filed: Jan. 11, 1991

[30] Foreign Application Priority Data

Jan. 17, 1990 [EP] European Pat. Off. ..... 90200122.1

[51] Int. Cl.[5] ..... G03G 15/06

[52] U.S. Cl. ..... 355/245; 355/260; 366/81

[58] Field of Search ..... 355/245, 246, 260, 210, 355/200, 253; 118/653; 366/318, 319, 81

[56] References Cited

U.S. PATENT DOCUMENTS

| | | | |
|---|---|---|---|
| 4,878,089 | 10/1989 | Guslits et al. | 355/253 |
| 4,928,145 | 5/1990 | Okamoto et al. | 355/245 |
| 4,963,033 | 10/1990 | Huber et al. | 366/81 |

FOREIGN PATENT DOCUMENTS

| | | | |
|---|---|---|---|
| 63-133171 | 6/1988 | Japan | 355/253 |
| 1-116574 | 5/1989 | Japan | 355/253 |
| 1-201684 | 8/1989 | Japan | 355/260 |

*Primary Examiner*—R. L. Moses
*Assistant Examiner*—Shuk Y. Lee
*Attorney, Agent, or Firm*—William J. Daniel

[57] ABSTRACT

An electrostatic latent image developing assembly having a first feed passage for feeding developing material in a first direction, a second feed passage for feeding the developing material in a direction opposite to the first direction. A helical feed screw in the first feed passage, a helical supply screw in the second feed passsage for supplying part of the developing material to a developing sleeve, a connection between both sets of adjacent ends of such feed passages for permitting the developing material to circulate between the passages, wherein the feed screw and supply screw are disposed in parallel relation and the supply screw is provided with buckets around its periphery, the supply screw having a helical blade for advancing developing material in the second feed passage axially thereof while the buckets move the material circumferentially. Preferably, the radius of the helical blade reaches to at least one-half the depth of the buckets.

15 Claims, 7 Drawing Sheets

CIRCUITOUS-FLOW ELECTROSTATIC DEVELOPER ASSEMBLY WITH CONCURRENT AXIAL AND CIRCUMFERENTIAL PARTICLE MOVEMENT

BACKGROUND OF THE INVENTION

1. Field of the invention

The present invention generally relates to electrophotography and more in particular to an electrostatic latent image developing device for use in developing electrostatic latent images formed on the surface of an electrostatic image support member in an electrophotographic process.

2. Description of the prior art

In electrostatic latent image developing devices it is known to transport the developing material which is supported in the form of a magnetic brush, on the outer peripheral surface of a developing sleeve in a circumferential direction of said sleeve so as to develop an electrostatic latent image formed on an electrostatic latent image support member by causing the developing material to rub against the surface of said support member at a developing region where said developing sleeve and said electrostatic latent image support member confront each other.

The developing material is supplied to the rear side of the developing sleeve opposite from the developing region thereof, and at the time it is picked up by the sleeve the developing material (usually composed of a mixture of carrier and toner) must be fully mixed and stirred, with toner particles therein being sufficiently triboelectrically charged, and sufficiently uniformly distributed along the length of the sleeve.

In order to satisfactorily mix and stir the developing material, it is known to use neighbouring feeding passages through which the developing material is fed in opposed directions by means of a sleeve incorporated with a magnet roller disposed in each feeding passage, thereby to circulate the developing material through end openings in a partition wall which separates the feeding passages. This arrangement is disclosed in Japanese Patent No. 1,068,753 to Kokkosho.

Since the feed passages are disposed in parallel relation to each other, and since end portions of the feeding passages are closed in the feeding direction to be accumulated in stopped, the developing material tends to be excessively large amounts downstream of the feeding direction in each feed passage, and in undesirable small amounts upstream thereof, and therefore deviation in the amount of the developing material takes place in the axial direction of the developing sleeve, thus leading to uneven development across the width of the developed image.

This problem has been recognized in U.S. Pat. No. 4,721,982 to Minolta, and in said patent an electrostatic latent image developing apparatus is disclosed in which two adjacent feeding passages are disposed in a non-parallel relation to each other.

This measure complicates the construction of the device since the rotating feed means of at least one feed channel is mounted in a tilted position which necessitates the provision of bearings the axis of which is not normal to the sidewall of the apparatus, and also gear wheels that are inclined to the vertical, and that must co-operate with other gear wheels that are rotating in a truly vertical plane.

Further, the buckets of the supply roller in this device are arranged outside of the helical vane or vane sections that produce the axial transport of the developing material through the feed passage. We have found that the axial feeding function in suchlike arrangement may become unsatisfactory, in particular in case the developing composition comprises a carrier based on ferrites and the toner particles are very fine, since this kind of developer mixture lends itself less readily to axial transport by screw means.

SUMMARY OF THE INVENTION

Objects of the Invention

It is an object of the present invention to provide an electrostatic latent image developing device in which the axes of rotation of the several rotatable means for feeding, stirring and supplying the developing material to the latent image bearing support run parallel to each other whereby the journalling and the driving of the distinct roller means are simplified, but without causing developing material to stagnate near the downstream end of the feed passages, or to become unevenly applied along the developing sleeve which is particularly desirable for use with less easily transportable developing materials.

STATEMENT OF THE INVENTION

According to the present invention, an electrostatic latent image developing device which comprises a first feed passage for feeding developing material in a first direction, a second feed passage provided side by side, adjacent to the first feeding passage for feeding the developing material in a direction opposite to the first direction, each of said feed passages having an upstream end and a downstream end connecting, passage means communicating between the first and second feed passages at their respective opposite ends whereby the developing material circulates from one passage to the other, a rotatable developing sleeve having a magnet roller incorporated therein and capable of holding the developing material on its peripheral surface, a helical feed screw in said first helical feed passage, and a supply screw in said second feed passage for supplying part of the circulating developing material onto said developing sleeve, is characterised in that the feed roller and the supply roller run parallel with each other, and that the helical screw combined with buckets, which are provided around the periphery of the said screw and the helical blade of the screw extends from the core of said roller radially outwardly up to at least half the radial depth of the buckets.

The term "screw feed roller" stands in the present specification for a rotatable helical member that operates as a screw conveyor for axially displacing developing material that is engaged thereby. The screw feed roller has a helical screw blade fitted to a central core. The screw blade may be formed by one helical vane, but it may also take the form of a plurality of axially spaced helical vanes thereby to form multi-flutes.

The term "buckets" stands for developing material intercepting means that are circumferentially spaced on the supply roller, and that scoop up the developing material for feeding onto the outer peripheral surface of the developing sleeve. The feeding action of the buckets is thus in essence tangential, as distinct from the feeding effect of the helical screw blade which is essentially axial.

According to a suitable embodiment of the invention, the helical blade of the supply roller extends up to the radially outermost end of the buckets.

The improved axial feeding effect of the supply roller in the device according to the present invention is based on the large radial space which exists between the core of the roller and the peripheral buckets, and on the radial dimension of the helical blade which reaches from the core up to at least half the radial depth of the buckets.

Both measures provide a large axial feeding rate, whereas the peripheral position of the buckets ensures also a large tangential or circumferential feeding rate. The latter feeding is not only important for the supply of developing material to the developing sleeve, but also for the feeding of the developing material through the connecting passage means at the downstream end of the supplying roller towards the upstream end of the feed roller. The mentioned passage means is mostly upwardly directed since the feed roller is usually located higher than the supply roller. This has the advantage that the feeding of the developing material through the passage means at the downstream end of the feed roller towards the upstream end of the supplying roller occurs in downward direction so that there are less problems with stagnation at the downstream end of the feed roller, and with a consequently insufficient supply at the upstream end of the supplying roller.

According to a suitable embodiment of the invention, the buckets extend uninterruptedly over the full length of the supplying roller. In this way a uniform supply of developing material along the length of the developing sleeve may be obtained.

According to a further particular feature of the invention, the two feed passages are formed in a housing that comprises a central part or section with a uniform cross-section over its length, a partition wall separating the two feed passages, and two end parts or section that each enclose a chamber which defines said passage means for communicating said first and second feeding passages.

In a device with a housing that comprises three parts as described, the central part at least is suitably made from an electrically conductive material such as aluminium. This has the advantage over insulating materials, e.g. a part injection moulded from a thermoplastic resin, that the complete surface of the part is at a uniform and well-controlled potential whereby a corresponding more uniform charging of the developing material is obtained.

The device according to the present invention is suited for use in electrographic and electrophotographic copying and printing apparatus to develop the electrostatic image that has been formed on an electrostatic latent image support member, usually in the form of a photoconductive drum.

The image formation may occur by scanningwise exposing the photoconductive drum to the image of an original, produced by an optical projection system, but the exposure of the drum may also occur by an image-wise modulated scanning laser beam, or by image-wise activated light-emitters, such as LED's, that are arranged in a row that extends parallel with the photoconductive drum.

The device according to the present invention has been particularly developed for use in electrophotographic apparatus for the production of offset plates for use in the graphic industry.

In one form, such plates may consist of a polyethylene terephthalate support which is provided with a suitable subbing layer, onto which the toner image from a photoconductive drum is transferred and then fixed. Because of the application for graphic purposed, the development of the electrostatic image is carried out by means of a developing material consisting of very fine toner particles in order to obtain a high resolution of the image. To this end, the development may be carried by means of electrostatic toner particles having a size distribution wherein more than 50 percent by volume of the toner particles have equivalent size diameters of less than about 5 microns. Toner particles with the mentioned characteristic are disclosed in our co-pending application entitled "Dry electrostatic toner composition", filed on the Jun. 28, 1989.

We have found that carrier particles of the size range when constituted by ferrites, form a developing mixture that is more difficult to feed and supply in an electrostatic developing device than the more usual composite carrier mixtures, and it has been shown that the device according to the present invention operates very satisfactorily for developing an electrostatic image by means of this kind of developing material. The favourable characteristics of the inventive device equally apply to more conventional toner mixtures.

BRIEF DESCRIPTION OF THE DRAWINGS

These and still other features of the device according to the present invention are described hereinafter by way of example with reference to the accompanying drawings wherein.

DETAILED DESCRIPTION OF THE INVENTION

Figure 1:
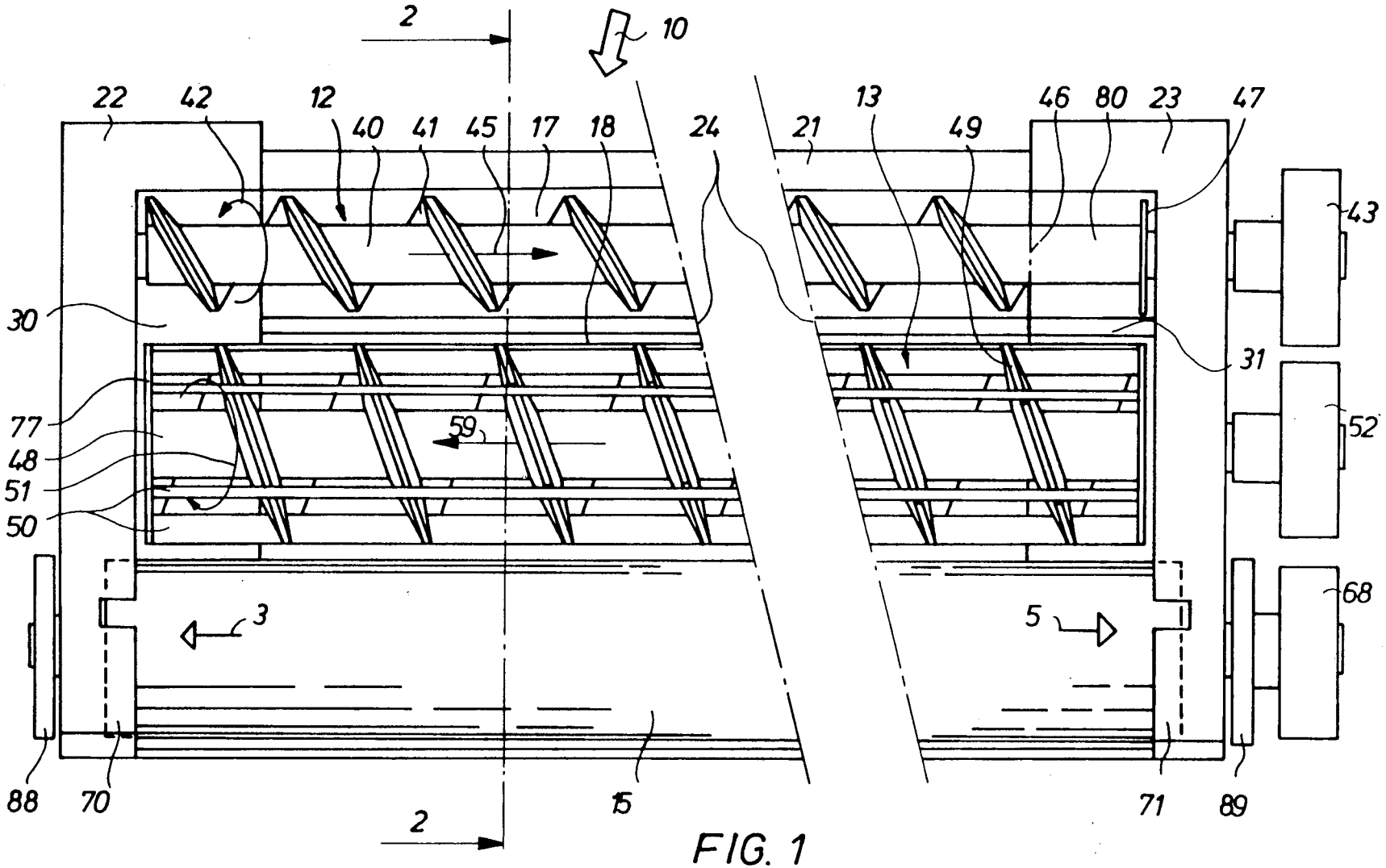
FIG. 1 is a plan view of one embodiment of a developing device according to the present invention.
Figure 2:
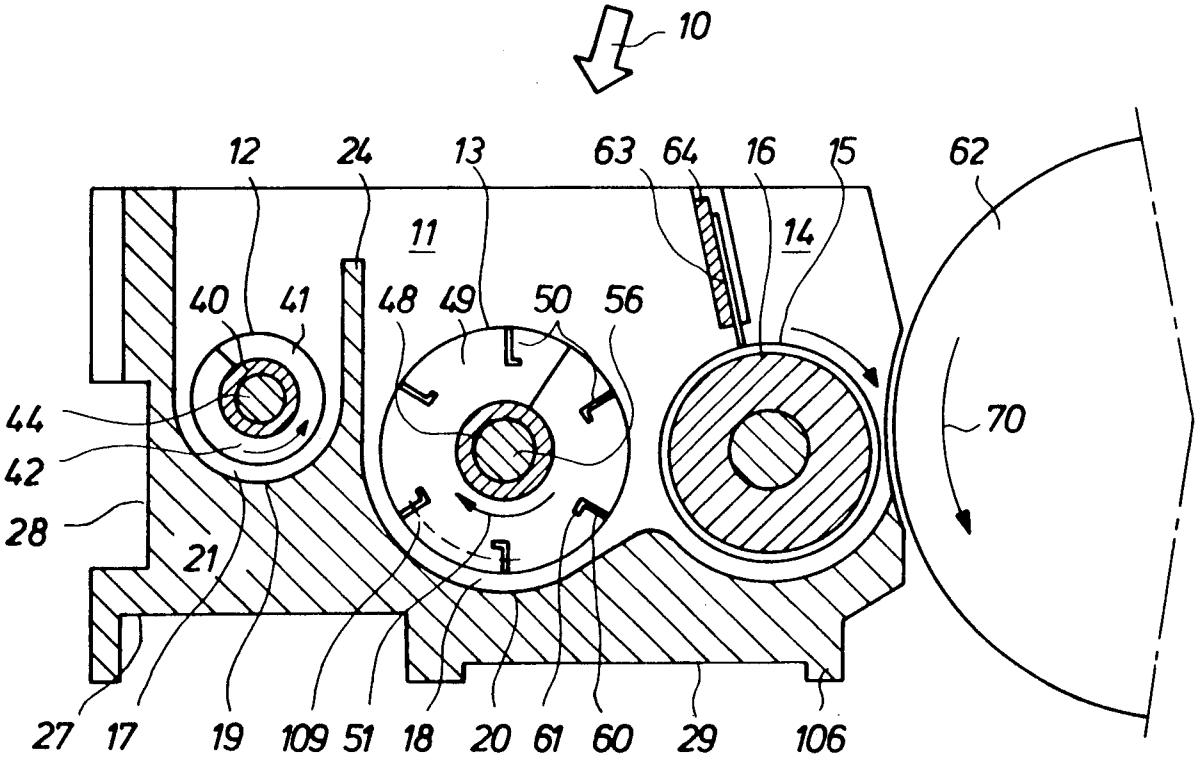
FIG. 2 is a cross-sectional view on line 2—2 of FIG. 1.
Figure 4:
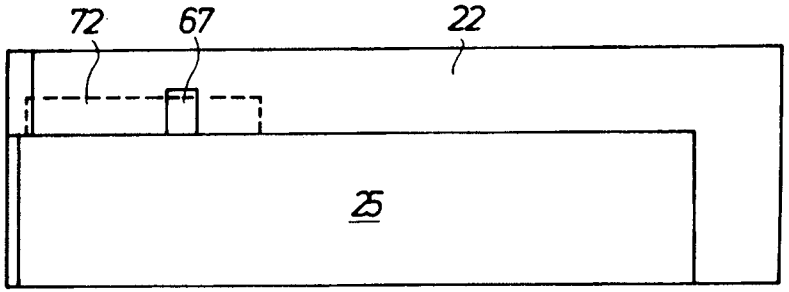
FIG. 4 is a plan view of the left-hand end part of FIG. 3.

Referring to FIGS. 1 and 2, there is shown an electrostatic latent image developing assembly according to one embodiment of the invention, which generally comprises a housing 10 with a developing material circulating in a feeding section 11 provided with a feed roller 12 in the form of a screw roller and a supply roller 13, and a developing section 14 including a developing sleeve 15 with a magnet roller 16 incorporated therein.

The assembly also comprises a toner accomodating section ahead of the feeding section 11 with a hopper arranged for accommodating a toner bottle or cartridge for toner replenishment of the device. This latter section is irrelevant for the description of the inventive embodiment, and is therefore not further dealt with hereinafter.

The feeding section 11 includes a developing material mix, stirr and feed passage 17 and a developing material supply and feed passage 18 which are respectively formed by concave curvatures 19 and 20 of the bottom portion of the housing 10. The housing as such is an assembly of a central part or section 21, and two end parts or sections 22 and 23. The central part or section 21 has a uniform cross-section along its length and has an upright partition wall 24 that separates the two passages 17 and 18 from one another. The part or section 21 may suitably be manufactured from aluminium, e.g. by extrusion moulding.

The end parts 22 and 23 have a generally rectangular shape, and enclose a chamber 25, respectively 26 provided at the side which faces the central part 21, thereby leaving an L-like top face on said end parts. The end parts are suitably manufactured by injection moulding from an appropriate plastic material.

The end parts have been illustrated in detail in FIGS. 3 to 6. The end part 22 has recessed portions 100 and 101 at the bottom and the rear face that correspond with the recessed portions 27 and 28 of the central part 21. The end part 23 has a recessed portion 102 that is smaller than the portion 27 thereby to provide a leg 97, and a recessed portion 103 that corresponds with the recess 28 of the central part 21. The purpose of the recesses 27, 100, and 102 is to guide the device along a bar that will be described futher. and the purpose of the recesses 101, 28 and 103 is to provide a recessed face that is in contact with springs for urging the device in the correct position in an electrophotographic apparatus.

Finally, the end parts have a front guide leg 104, resp. 105 that corresponds with the guide leg 106 of the central part 21, for the guidance of the device into the apparatus.

The feed passages 17 and 18 communicate with each other through a connecting passage means in the form of openings 30 and 31 at the extremities of the partition wall 24 and the corresponding wall of the end parts 22 and 23. Said openings are simply formed by the chambers 25 and 26 in the parts 22 and 23.

Figure 3:
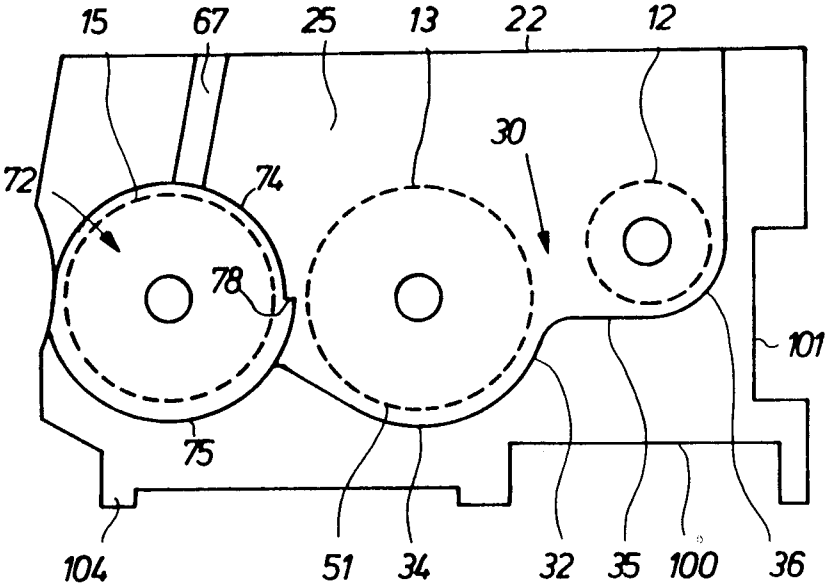
FIG. 3 is an elevational view of the left-hand end part according to the arrow 3 of FIG. 1.
Figure 6:
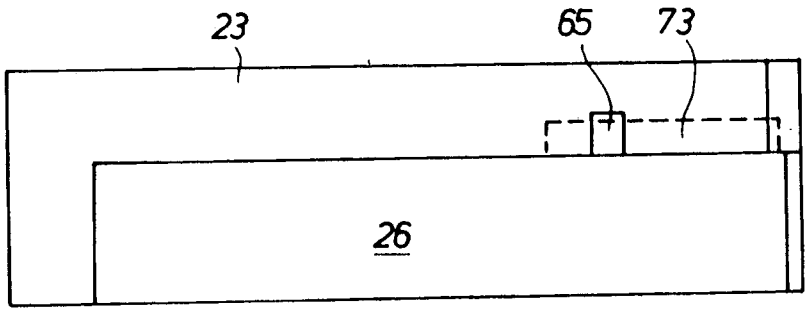
FIG. 6 is a plan view of the right-hand part of FIG. 5.

The bottom surface of the connecting passage means 30 has a stepped configuration 32, which comprises the curved section 34, the straight horizontal section 35 and the corner section 36, see FIG. 3.

Figure 5:
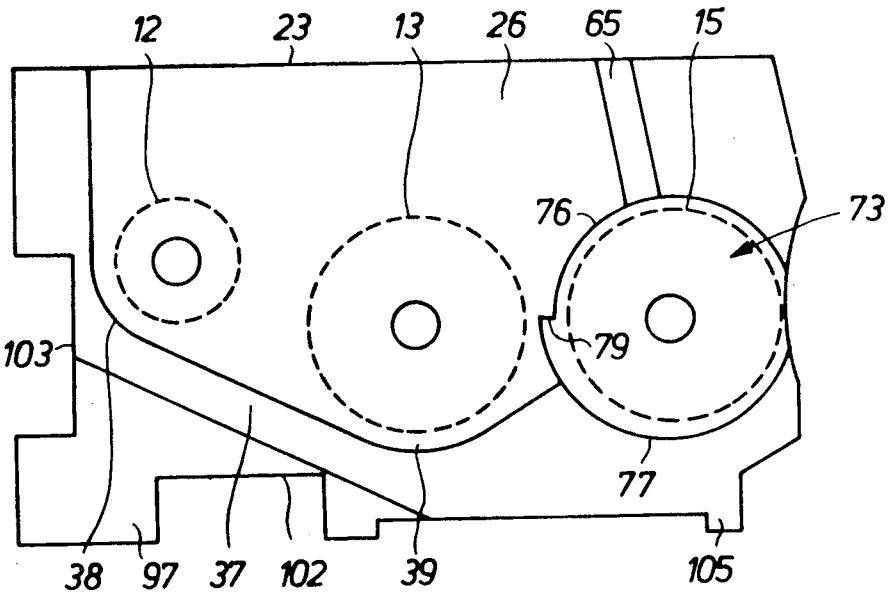
FIG. 5 is an elevational view of the right-hand end part according to the arrow 5 of FIG. 1.

The bottom surface of the connecting passage means 31, on the contrary, has a straight, inclined section 37, which forms the transition between the curved sections 38 and 39, see FIG. 5. The rollers 12 and 13 have been illustrated in broken lines in FIGS. 3 and 5.

The screw feed roller 12 comprises a cylindrical core 40 and a helical blade 41 fitted to said core, and is arranged to be driven for rotation in a direction indicated by the arrow 42 in FIG. 1 through the intermediary of a toothed gear 43 fitted on the end of the shaft 44 that extends through the end part 23. The axis of the roller coincides with the axis of the concentrically curved bottom surface 19 of the feed passage 17, see FIG. 2. The function of this roller is to mix and stir the developing material, while feeding said material in the direction of the arrow 45 (FIG. 1) based on its rotation in the direction of the arrow 42 (FIG. 2). The helical blade 41 extends uninterruptedly from the core 40 up to the circumference of the roller, and also uninterruptedly from the upstream end of the roller at the wall 22 up to the position indicated by the dash-and-dot line 46 in FIG. 1 where the connecting passage means 31 towards the supply roller begins.

The object of keeping the downstream end 80 of the roller free from the helical blade is to reduce the axial pressure of the developing material on the side wall of the end part 23, and thus also on the bearing of the roller provided in said part. The risk of developing material entering the roller bearing may be further reduced by providing a disc 47 at the downstream extremity of the core 40 of the screw feed roller 12 to cover the bearing. The screw feed roller, i.e. the blade and the core, is suitably integrally made from plastics, whereas the shaft 44 of the roller is made from steel and is journalled for rotation by means of roller bearings that are press-fitted in corresponding bores in the end walls 22 and 23.

The supply roller 13 comprises a cylindrical core 48 and a helical blade 49, and six buckets 50 connected with the blade in 60° angular spaced relationship around its periphery. The roller is arranged to be driven for rotation in a direction indicated by the arrow 51 in FIG. 1 through the intermediary of a gear 52 fitted to the end of the roller shaft 56 that protrudes through the end wall 23. The axis of the roller coincides with the axis of the curved bottom surface 20 of the feed passage 18.

The buckets 50 are elongated L-shaped members that extend uninterruptedly over the full length of the roller 13, except for the places where they are intersected by the helical blade 49 of the roller.

Figure 8:
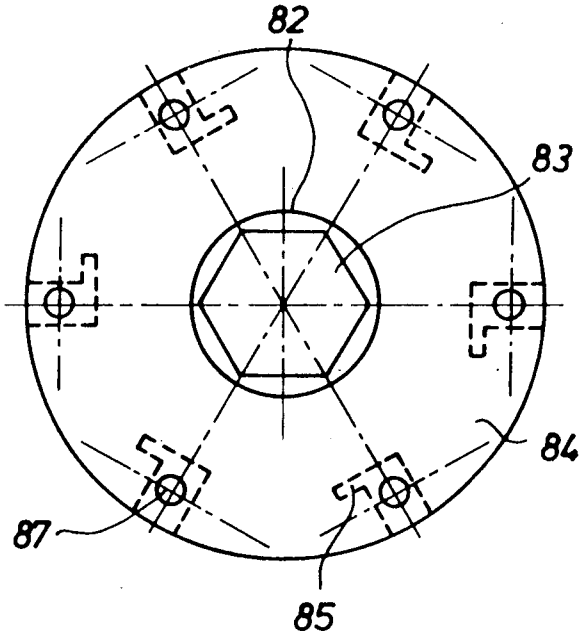
FIG. 8 is an axial view of the segment of FIG. 7.
Figure 7:
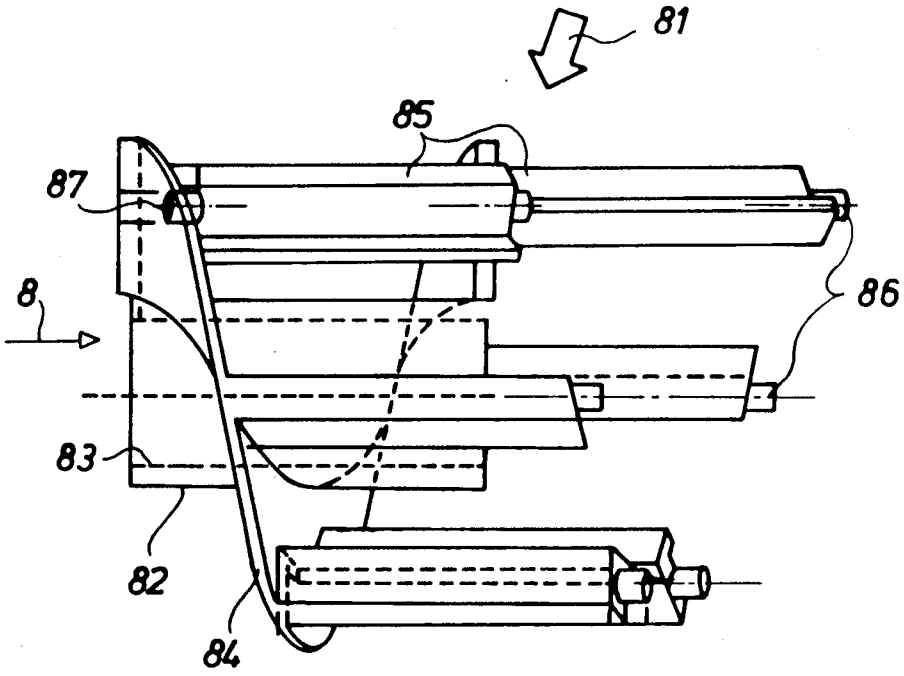
FIG. 7 is an elevational view illustrating one segment of a supplying roller which is assembled from a plurality of identic segments.

The buckets have a long leg 60 that extends almost radially of the roller, see FIG. 2 and a short leg 61 at the interior end that is normal to the long leg. The buckets may be metal members that are fitted in the roller by sliding and next glueing them in correspondingly angled slotlike openings in the helical blade, but said buckets as well as the blade and the core may be made from plastic, and be integrally moulded. FIGS. 7 and 8 which will later be described are illustrations of such integral moulding.

The free end of the long leg of the buckets coincides with the outer diameter of the supply roller 13, thereby to produce a maximum tangential velocity component for the developing material.

The supply roller functions to axially feed the developing material as mentioned already, but also to scoop up said material by means of the buckets for feeding it onto the outer peripheral surface of the developing sleeve based on the rotation in the direction of the arrow 51. Since the buckets extend uninterruptedly from one end to the other of the supply roller, and also the helical blade forms a continuous member, an extremely uniform supply of developing material is obtained along the length of the developing sleeve and consequently a uniform supply of developing material in the form of a magnetic brush occurs along the length of the photoconductor drum 62 which bears an electrostatic image on its peripheral surface.

A disc 77 (FIG. 1) is fitted to the downstream end of the supply roller in order to prevent developing material from getting into the roller bearing under the axial pressure of the developing material.

In operation of the two described rollers, developing material is transported in the direction of the arrow 45 in the feed passage 17, and in the direction of the arrow 59 in the supply passage 18 based on the rotation of the screw feed roller 12 in the direction of the arrow 42 and rotation of the supply roller 13 in the direction of arrow 51. The developing material transported in the direction of arrow 45 and arriving at the downstream end portion of the feed passage 17 is encouraged by on the sloping surface 37 to pass through the connecting opening 31 so as to move into the upstream end of the supply passage 18. Meanwhile, the developing material transported in the direction of the arrow 59 and reaching the downstream end portion of the supply passage 18 is scooped up by the buckets 50 and returned through the connecting opening 30 into the upstream end of feed passage 17. This latter transport is greatly facilitated by the platform-like surface section 35 of the bottom wall which operates to receive and hold an amount of developing material supplied by the buckets through the connecting opening 30 so that the helical blade of the feed screw 12 gets a liberal supply of developing material at its upstream end, which material is subsequently displaced along the roller axis towards the downstream end.

This arrangement explains why no problems arise with stagnation of developing material at the downstream end of the feeding passage 18 because the material is efficiently removed at said end.

Stagnation of developing material neither occurs at the downstream end of the screw feed roller 12, since the level of the feed passage 17 is higher than that of the feed passage 18, and thus the transport of the developing material via the passage means 31 is promoted by gravity which causes the developing material to move from the surface section 38 to 39 via the slide surface 37.

Meanwhile, part of the developing material is scooped up by the buckets 50 while being transported in the direction of the arrow 59 through the supply passage 18, and is supplied onto the outer peripheral surface of the sleeve 15.

The developing section 14 includes the developing sleeve 15 mentioned already which is arranged for being driven by a gear 68 provided on one end of its shaft. A bristle height restricting blade 63 which is fitted to a support 64 the ends of which may clampingly fit in correspondingly inclined grooves 65 and 67 of the end plates 22 and 23, has its forward edge set at a certain distance from the sleeve. The developing sleeve is arranged to confront the photoreceptor surface of a photoconductor drum 62 driven in the direction of the arrow 70. Both shaft ends of the developing sleeve 15 extend through the corresponding end walls 22 and 23 of the drive, and are provided with idler rollers 88 and 89 that act as gap width controlling rollers by their running on corresponding sections of the photoconductor drum that are located outside of the image area.

The magnet roller 16 is in fact a stationary member which has a plurality of alternatively magnetized poles spaced angularly around its periphery as known in the art.

The magnet roller 16 has a length which corresponds with the length of the screw feed roller and the supply roller.

The sleeve 15, on the contrary, has a length that is slightly larger than the magnet roller so that both its end portions 70 and 71, see FIG. 1, are located within corresponding chambers or bores 72 and 73 of the end parts 22 and 23. These chambers have two half-circular peripheral wall sections, namely 74, 75 and 76, 77. The diameter of the sections 74 and 76 is smaller than the diameter of the sections 75 and 77 so that steplike crossovers such as the steps 78 and 79 are formed. The described configuration shows the advantage that a relatively large gap is formed at the lower half of the sleeve end so that developing material that still adheres to said end in spite of the absence of a magnetic field at that position, does not produce excessive friction. The small gap at the upper half of the sleeve limits the amount of developing material that is picked up at this location is likely to fall off the sleeve at the region where the sleeve end is freely exposed to the air, viz. where it confronts the photoconductor drum 62. Also, developing material that remains at said ends of the sleeve can easily get into the bearings of the sleeve. The steps 78 and 79 operate as a scraper to remove excess of developing material at the transition from the wider to the narrower gap. It will be understood that there may occasionally be provided scrapers sliding on the ends of the sleeve, to further reduce the presence of developing material at these places.

The driving mechanism for the different rollers described hereinbefore may take many known forms and is therefore not further described in this specification. It may comprise gear wheels, timing belts, as known in the art. In the present device which was intended for platemaking with high image quality, the gear wheels were provided with an inclined toothing, and the belt transmissions comprised flat Kevlar (registered trademark) belts in order to reduce any fluctuation of the nominal rotation speed of all members to a strict minimum.

The following date illustrate the device as described hereinbefore:

| | |
|---|---|
| Screw feed roller 12 | |
| roller length | 423 mm |
| section length | 10 mm |
| roller diameter | 20 mm |
| core diameter | 10 mm |
| pitch of the helical blade | 24 mm |
| revolutions | 122 rpm |
| Supply roller 13 | |
| roller length | 423.3 mm |
| roller diameter | 35 mm |
| core diameter | 13 mm |
| pitch of the helical blade | 24 mm |
| revolutions | 198 rpm |
| buckets | 6 × 3 mm |
| wall thickness (aluminium) | 1 mm |
| Developing sleeve | |
| length | 435.5 mm |
| diameter | 31.4 mm |
| revolutions | 122 rpm |
| Magnet roller | |
| length | 417.5 mm |
| diameter | 29.3 mm |
| Gap width determined by blade 63 | 0.65 mm |
| Photoreceptor drum | |
| length | 470 mm |
| diameter | 80 mm |
| circumferential speed (system speed) | 5 cm/sec |
| surface charge potential (electrostatic image potential) | 850 V |

Developing material: a two-component mixture consisting of ferrite carrier particles with an average size of 70 um (micrometer) and toner particles featuring a classified size distribution wherein more than 90 percent of volume of the toner particles have equivalent particle size diameters larger than 5 um, and less than 7 um, and more than 50 percent by volume of the toner particles have equivalent particle size diameters of less than about 5 mm, and wherein the ratio of the apparent density over the bulk density of the toner particles satifies the following equation:

$$\frac{app}{\text{bulk}} > 0.2$$

More details about suitable two-component mixtures for use as developing material that exhibit superior performance in terms of overall performance in the electrophotographic process, may be found in our co-pending EU application entitled: "Dry electrostatographic toner composition", filed Jun. 28, 1989.

A suitable construction of a supply roller in a device according to the present invention is illustrated in the elevational view of FIG. 7 which shows one segment of a supply roller which is assembled from a plurality of identic segments, and in FIG. 8 which is an axial view according to the arrow 8 of FIG. 7.

The supply roller section 81 comprises a cylindrical core section 82 with a hexagonal bore 83, and a helical blade 84 with six buckets 85 projecting therefrom in parallel with the axis of the core. The buckets are L-shaped and have at their free end a cylindrical stud 86 which can engage a corresponding hole 87 of the next section.

The supply roller is assembled from a plurality of the illustrated segments which are slid over a steel shaft having a hexagonal cross-section and cylindrical ends. The studs 86 of one segment engage the corresponding holes 87 of the next segment, and so on. At one end of the roller there is a different segment that is free from the projecting buckets 85. The segments may be fixedly attached to the shaft by glueing, but they may also be clamped between two end nuts that fit on a screw-threaded section of the shaft. The illustrated configuration of a supply roller section allows the integral injection moulding from a suitable plastics. An end disc such as 77 shown in FIG. 1 may be provided as a separate item on the roller shaft to protect the downstream bearing of the supply roller.

The correct positioning of the illustrated developing device in an electrophotographic apparatus is described hereinafter with reference to FIGS. 9 and 10.

Figure 9:
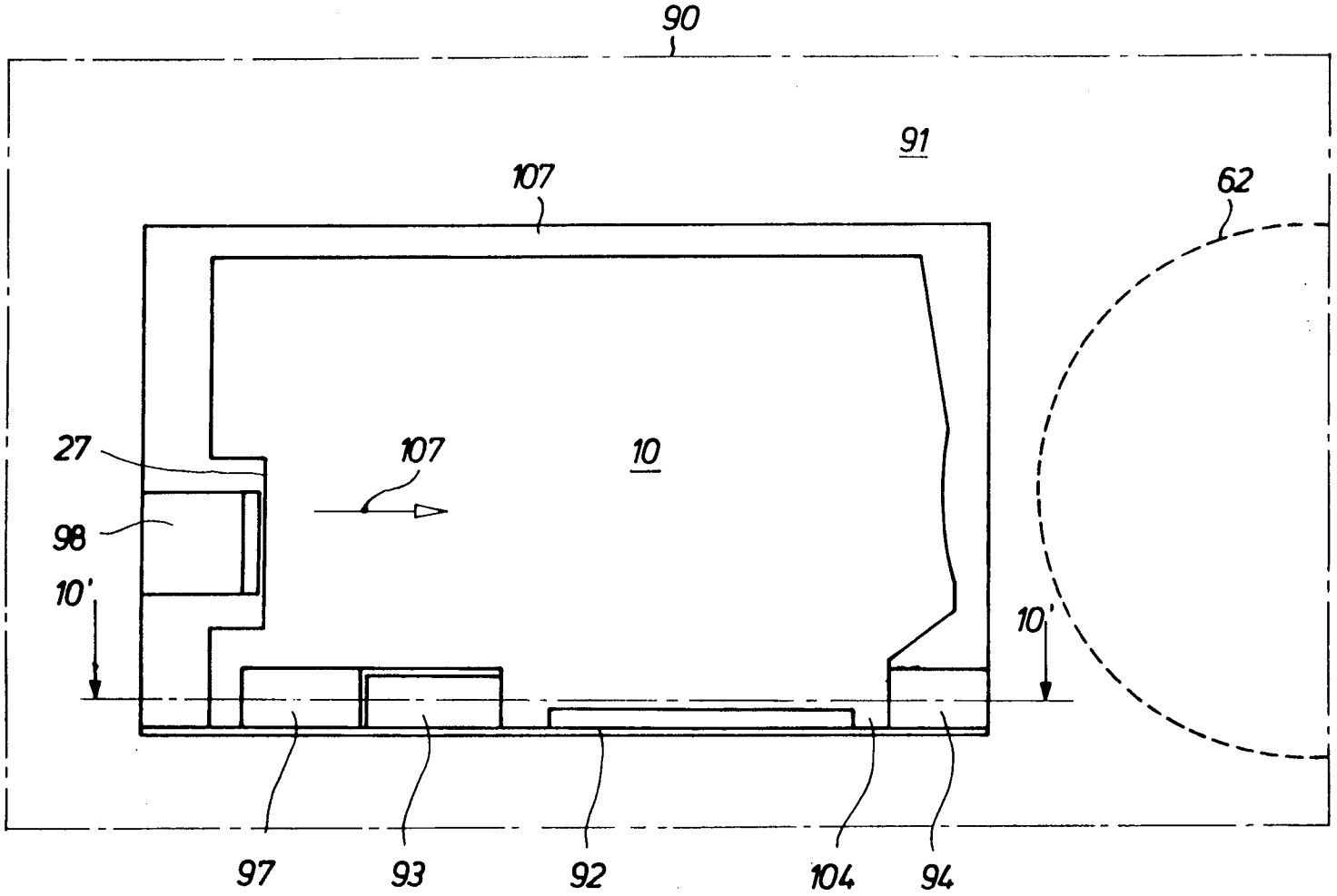
FIG. 9 is a lateral view of the positioning of the developing device in an electrophotographic apparatus.

Referring to FIG. 9, a section 90 of a lateral wall 91 of an electrophotographic apparatus is shown, which has an opening 100 through which the developing assembly 10 may be laterally slid into and removed from the apparatus as a unit. The position of the photoconductive drum 62 in the apparatus is shown in broken lines.

A bottom plate 92 is located in the opening 100 onto which a guide bar 93 with a rectangular cross-section, and a guide element 94 are fitted. FIG. 10 which is a horizontal section on line 10'—10' of FIG. 9 gives more details on these guides. The section of FIG. 10 illustrates in fact two positions of the developing device, namely a first one in true section (illustrated by the right-hand hatching) which shows the assembly as it has just been introduced into the opening 107, and a second one in broken lines 99 which shows the end position of the device in confronting relation with the photoconductive drum 62.

The guide bar 93 ends shortly before the opposite lateral wall 95 of the apparatus and has an inclined end face 96. The guide element 94 has a triangular shape as shown.

Figure 10:
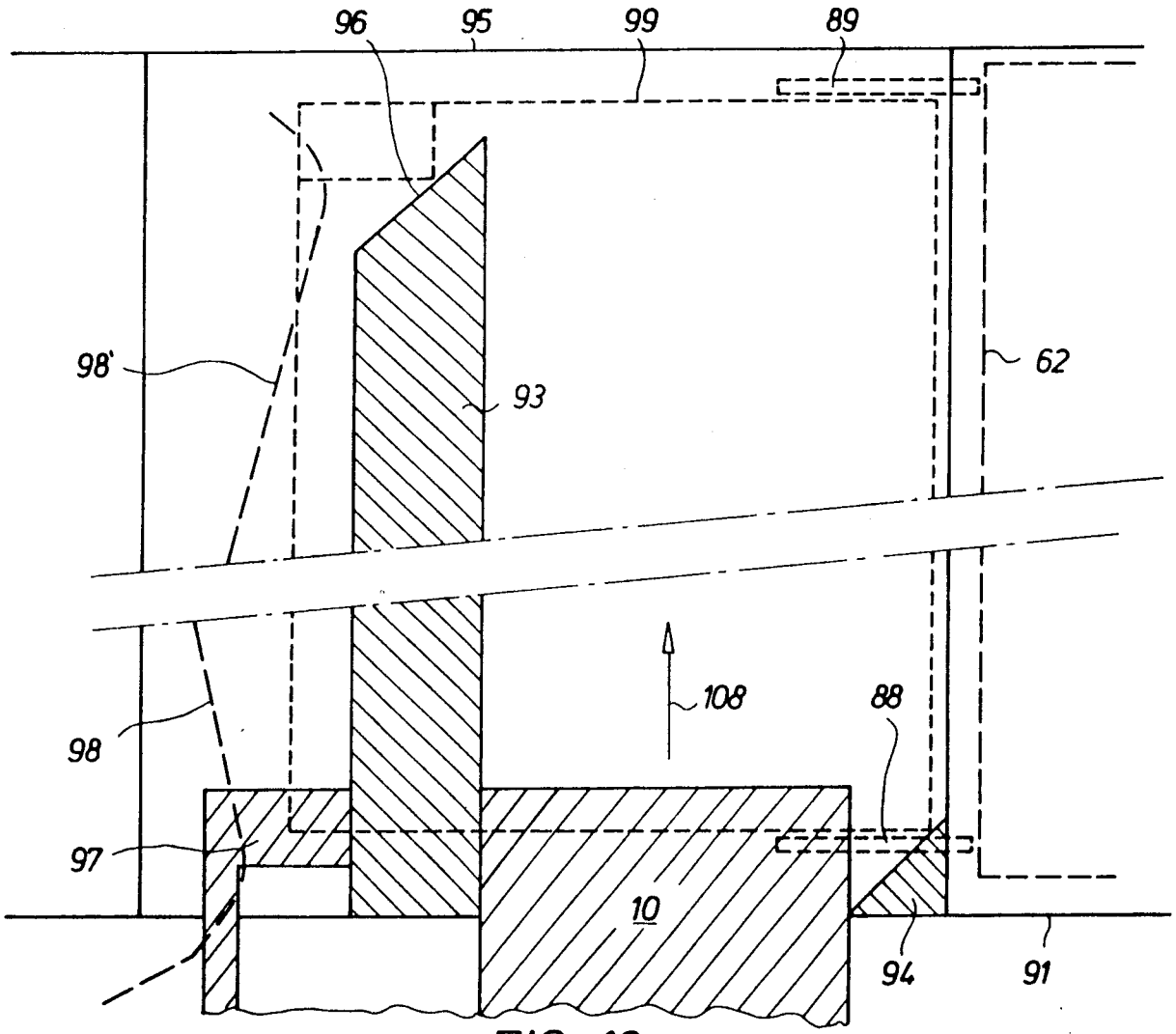
FIG. 10 is a horizontal section on line 10'—10' of FIG. 9.

The apparatus comprises further two leaf springs 98 and 98' that are fitted to a lateral wall of the opening 107 and that have been illustrated in broken lines in the section of FIG. 10 although strictly spoken they are not visible on this section.

The operation of inserting the developing assembly into the apparatus is as follows.

The device takes initially a position as shown in as shown in solid lines in FIG. 10. The guide formed by the members 104, 105 and 106 slides along the guide element 94, whereas the guide leg 97 on the end section 23 of the assembly slides along the bar 93, under the lateral pressure exerted on the device by the leaf springs 98 and 98', the free ends of which are situated in the recessed channel of the device formed by recesses 101, 103 and 28. The springs urge the device towards the right-hand side, as indicated by the arrow in FIG. 9. For the sake of clarity, a small space has been left in FIG. 9 between the guide leg 97 and the bar 93.

The developing assembly is pushed further into the apparatus as indicated by the arrow 108 in FIG. 10, until the guide leg 97 starts to slide along the inclined face 96, and the guide leg 104 at the frontside of the device slides along the inclined face of guide element 94, all this under the biasing force of the leaf springs. The device takes an end position as shown by the rectangle 99 in broken lines which is determined by the contact of the idler rollers 88 and 89, also shown in broken lines with the photoconductive drum 62.

The described positioning mechanism has a very simple construction, which is free from any rotational component as usual in the art, and yet it allows a very accurate and reproducible positioning of the developing device in the electrophotographic apparatus, without risk for damaging the photoconductive drum by inadvertent movements from the developing device.

The developing assembly according to the invention is not limited to the illustrated embodiment.

There may be more than one helical blade on the supply roller. The number of buckets of the supply roller may be different from six. The helical blade of the supplying roller may reach up to only half the radial depth of the buckets as illustrated diagrammatically by the circle segment 109 in broken lines in FIG. 2.

We claim:

1. In an electrostatic latent image developing assembly which comprises means for defining a first feed passage for feeding developing material in a first direction, means for defining a second feed passage arranged in side by side relationship adjacent to said first feed passage for feeding the developing material in a direction opposite to the first direction, each of said feed passages having an upstream end and a downstream end, connecting passage means for communicating between said first and second feed passages at their respective opposite ends to circulate said developing material between said feed passages, a rotatable developing sleeve having a magnet roller incorporated therein and capable of holding the developing material on its peripheral surface, a helical feed screw in said first feed passage, and a helical supply screw in said second passage feed passage for supplying part of the circulating developing material onto said developing roller, in combination, the improvement wherein said feed screw and said supply screw are disposed parallel with each other, and said supply screw is provided with buckets located around the periphery thereof region and the helical screw has a core and a helical blade which extends from said core radially outwardly to at least about half the radial depth of the buckets.

2. A developing assembly according to claim 1, wherein the helical blade of the supply screw extends radially as far as the radially outermost end of the buckets.

3. A developing assembly according to claim 1, wherein the buckets have an L-shaped cross-section having one long leg and one short leg, the long leg extending radially and the short leg tangentially with respect to the supply screw, 4. A developing assembly according to claim 1, wherein the buckets extend uninterruptedly over the full length of the supplying roller, except for the intersections with the helical blade of the supply screw.

5. A developing assembly according to claim 1, wherein the two feeding passages are formed in a housing (10) that comprises an elongated central section with a uniform cross-section over its length, and two end sections each end losing a generally chamber (25, 26) defining said passage means for communicating said first and second feeding passages.

6. A developing assembly according to claim 5, wherein said central section includes a interior partition wall stretching over its full length that extends upwardly from a bottom wall and separates said two feeding passages.

7. A developing assembly according to claim 5, wherein said central section is made of an electrically conductive material.

8. A developing assembly according to claim 1, wherein the first feed passage is located at a higher level than the second feed passage, and wherein the communicating passage means between the downstream end of said second feeding passage and the adjacent upstream end of said first feed passage has a stepped bottom surface with a horizontal section located partly under the upstream end of the feed screw of the first feed passage.

9. A developing assembly according to claim 1, wherein the first feeding passage is located at a higher level than the second feed passage, and wherein the communicating passage means between the downstream end of said first feed passage and the adjacent upstream end of said second feed passage comprises an inclined, straight bottom surface.

10. A developing assembly according to claim 1 hereinbefore, wherein the helical blade (41) of the feed screw in the first feed passage has a reduced diameter (80) at the downstream end of said feed passage.

11. A developing assembly according to claim 1, which is arranged for introduction into an electrophotographic apparatus in parallel with, but separated from a photoconductive drum and for bodily displacement towards said drum at the end of its insertion in the apparatus.

12. A developing assembly according to claim 1, wherein the end sections of the housing includes bores for receiving end portions of the developing sleeve and the lower portion of said bores has a larger radius than the upper section thereofwith an axial shoulder at the transition between said portions, said shoulder intercepting developing material which is carried upwardly by said end portions of said sleeve.

13. A developing assembly according to claim 10 where in said reduced diameter of the helical equals the diameter of said core.

14. A developing assembly according to claim 11, wherein the electrophotographic apparatus is provided with a guide member with an inclined guide face at the entry end of an opening for introduction of the assembly and an elongated bar with an inclined end face and the assembly carries cooperating guide surfaces.

15. A developer assembly according to claim 1, wherein the peripheral extremity of the helical blade of the feed screw substantially coincides with the peripheral extremity of said buckets.

* * * * *

UNITED STATES PATENT AND TRADEMARK OFFICE

CERTIFICATE OF CORRECTION

PATENT NO. : 5,142,333

DATED : August 25, 1992

INVENTOR(S) : MARCEL F. VERBEEK ET AL

It is certified that error appears in the above-identified patent and that said Letters Patent is hereby corrected as shown below:

Col. 10, line 65, delete "region".

Col. 11, line 17, before "uniform", insert --generally--.

line 18, change "end closing" to --enclosing--, and delete "generally".

Signed and Sealed this

Ninth Day of November, 1993

*Attest:*

*Attesting Officer*

BRUCE LEHMAN

*Commissioner of Patents and Trademarks*